US007757537B1

(12) United States Patent
Hartranft

(10) Patent No.: US 7,757,537 B1
(45) Date of Patent: Jul. 20, 2010

(54) ACCESSORY FOR THE HANDLE OF A CONDUIT BENDER

(75) Inventor: Bruce W. Hartranft, St. Charles, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

(21) Appl. No.: 12/464,234

(22) Filed: May 12, 2009

(51) Int. Cl.
*B21D 7/04* (2006.01)
*A45B 9/04* (2006.01)

(52) U.S. Cl. ..... 72/458; 72/459; 135/77; 135/84

(58) Field of Classification Search ..... 72/458, 72/459; 135/68, 77, 84, 86
See application file for complete search history.

(56) References Cited

U.S. PATENT DOCUMENTS

| | | | | | |
|---|---|---|---|---|---|
| 2,584,537 | A * | 2/1952 | Benfield | ..... | 72/458 |
| 2,817,986 | A * | 12/1957 | Benfield | ..... | 72/459 |
| 4,269,056 | A * | 5/1981 | Kozinski | ..... | 72/459 |
| 4,899,771 | A * | 2/1990 | Wilkinson | ..... | 135/84 |
| 5,103,850 | A * | 4/1992 | Davis | ..... | 135/84 |
| 5,301,703 | A | 4/1994 | Kahn | | |
| 5,301,704 | A | 4/1994 | Brown | | |
| 5,409,029 | A * | 4/1995 | Davis | ..... | 135/68 |
| 5,713,382 | A | 2/1998 | Midcap | | |
| 5,727,419 | A * | 3/1998 | Walsten | ..... | 72/458 |
| 5,826,606 | A | 10/1998 | Davenport | | |
| 5,829,463 | A | 11/1998 | Galan | | |
| 7,143,629 | B1 * | 12/2006 | Chiu | ..... | 72/459 |
| D570,094 | S | 6/2008 | Wainwright | | |
| 7,520,154 | B1 * | 4/2009 | Pallotti | ..... | 72/458 |

* cited by examiner

*Primary Examiner*—David B Jones
(74) *Attorney, Agent, or Firm*—Cook Alex Ltd.

(57) ABSTRACT

An accessory for a conduit bender has a support member which attaches to the handle of the conduit bender. The support member includes a hand hold for grasping during conventional bending. The support member defines an anti-skid surface. The anti-skid surface has an area greater than the cross-sectional area of the conduit bender handle. When the handle is placed on a horizontal surface for a shoulder bend the anti-skid surface engages the horizontal surface and prevents the handle from skidding or slipping on the horizontal surface. An aperture in the anti-skid surface receives the end of a conduit for bend backs.

22 Claims, 10 Drawing Sheets

ACCESSORY FOR THE HANDLE OF A CONDUIT BENDER

BACKGROUND

The present application relates to conduit benders and is particularly concerned with an accessory that can be attached to the handle of a conduit bender to facilitate shoulder bending and conventional bending.

There are numerous types and styles of portable conduit benders which are used by electricians for bending conduit at a job site to form bends or curves of predetermined angles prior to installation of the conduit in a new or existing building. The conduit is used as a duct for housing electrical wiring. One of the most common types of conduit benders used by electricians has a head that includes an arcuate-shaped base or rocker portion with a longitudinally extending conduit-receiving groove formed therein. There is a conduit-engaging hook portion formed at one end and a foot treadle portion at the opposite end. An elongated handle is attached to the head for applying bending pressure to a section of conduit in combination with pressure applied to the treadle portion. Examples of these types of benders are shown in U.S. Pat. Nos. 2,584,537, 2,817,986 and 4,269,056, the disclosures of which are incorporated herein by reference.

Conventional use of the bender occurs with the head on a horizontal surface such as the floor and the handle extending upwardly from the floor. However, certain types of bends are best made with the tool inverted from its conventional orientation, i.e., the free end of the handle is placed on a horizontal surface and the head is up in the air, as illustrated in FIG. 1. Typically the horizontal surface is the floor, although it could also be a bench, a table top, a chair seat, the ground or the like. It will be understood that the term horizontal surface will be used herein to refer to all of these possibilities, even if such surface is not perfectly horizontal. Bends made with the tool in this inverted orientation are referred to as shoulder bends or air bends. Saddle bends, 3-point bends or 4-point bends are typically made using shoulder bends.

In the past a constant problem with shoulder bends has been stabilizing the free end of the handle on the horizontal surface. Shoulder bends typically result in forces being applied to the handle which rotate the handle about its contact with the horizontal surface. Thus, the handle does not remain perpendicular to the horizontal surface and forces having components lateral to the horizontal surface are applied to the handle. Often the horizontal surface is an unfinished floor made of material, e.g., concrete, which provides relatively little resistance to skidding or slipping of the free end of the handle. Thus, the bending forces applied to the handle create a tendency for the free end of the handle to kick out laterally or skid. This leads to inaccurate bends and lost time and materials as users struggle to keep the handle upright on the floor. Users sometimes try to counteract the skidding tendency of the handle by placing one foot next to the handle. But this only deters skidding in one direction. Even worse, it places the user's feet in an awkward position that leaves the user unbalanced just as he or she has to apply significant force to the conduit. This results in an unsafe condition.

SUMMARY

The present invention is a handle accessory for a conduit bender that stabilizes the handle during shoulder bending and provides a suitable hand hold during conventional bending. The handle accessory is attached to the free end of the handle. It has a support member that defines an anti-skid surface. The anti-skid surface increases the contact area between the accessory and a horizontal surface compared to the contact area available if the handle were used by itself. In one embodiment the anti-skid surface may have a non-planar contour, such as a convex contour. The convex contour allows the anti-skid surface to maintain a contact area in engagement with the horizontal surface even as the handle rotates during shoulder bends. The support member further includes a hand hold that provides a comfortable gripping portion during conventional bending. An aperture in the bottom of the accessory provides access to the interior of the handle, allowing insertion of a conduit therein for bend backs. The accessory enables an electrician to make safer, faster and more convenient bends, with greater control and accuracy.

These and other desired benefits of the invention, including combinations of features thereof, will become apparent from the following description. It will be understood, however, that a device could still appropriate the claimed invention without accomplishing each and every one of these desired benefits, including those gleaned from the following description. The appended claims, not these desired benefits, define the subject matter of the invention.

DETAILED DESCRIPTION OF THE DISCLOSURE

Figure 1:
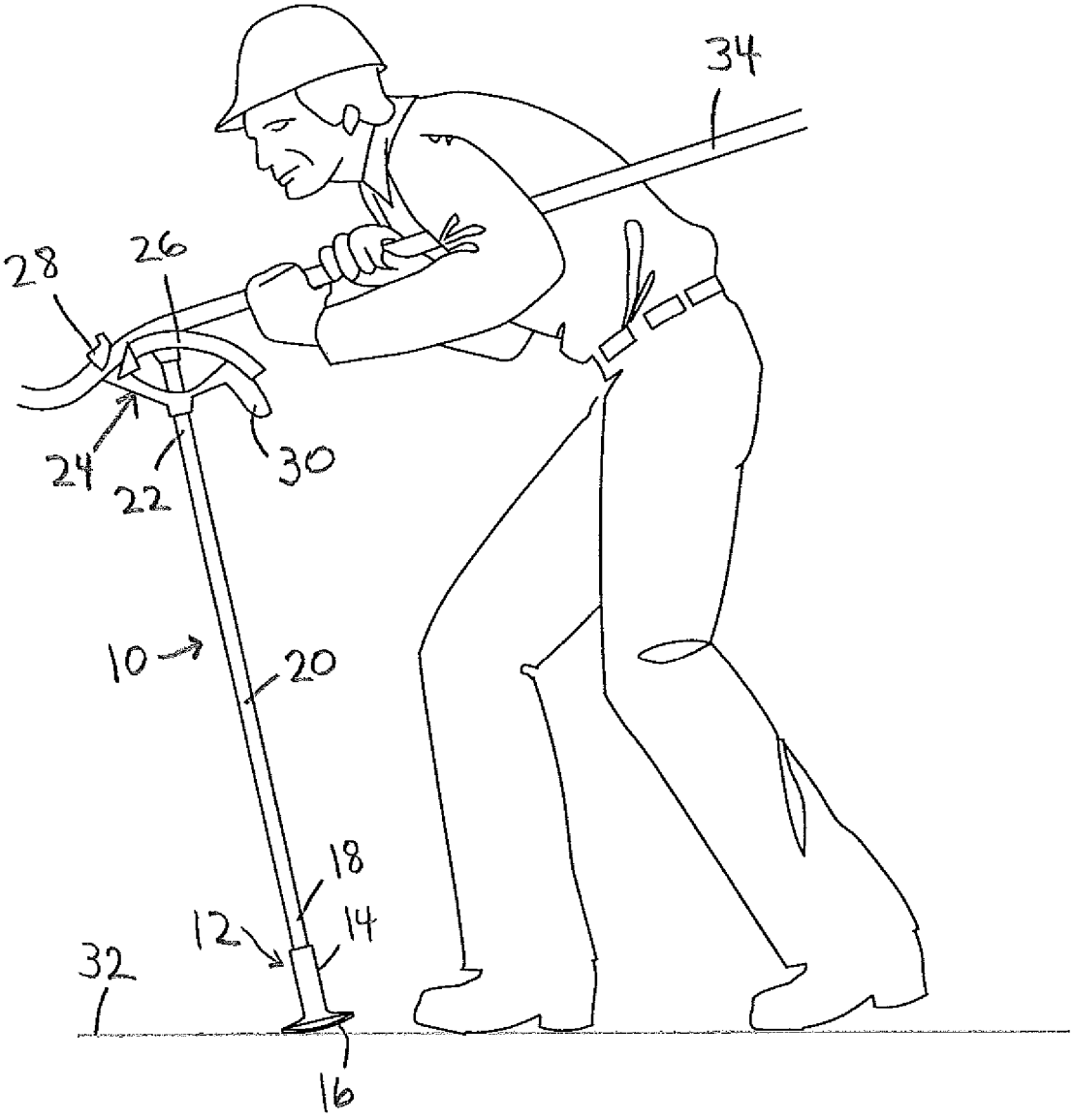
FIG. 1 is a diagrammatic view of conduit bender with the handle accessory of the present invention being used for a shoulder bend.
Figure 2:
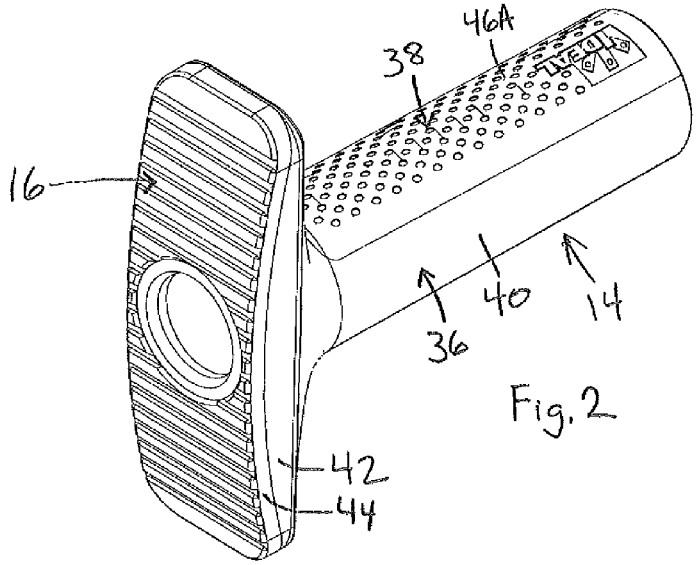
FIG. 2 is a perspective view of the handle accessory of the present invention.
Figure 3:
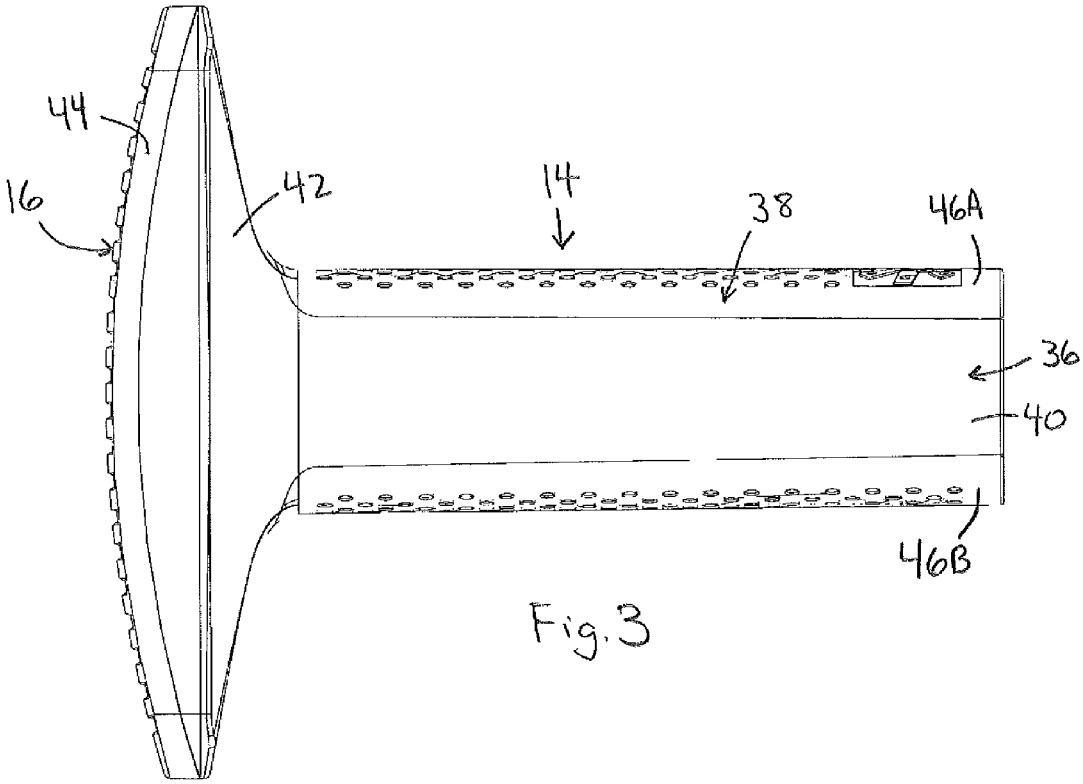
FIG. 3 is a side elevation view of the handle accessory.
Figure 4:
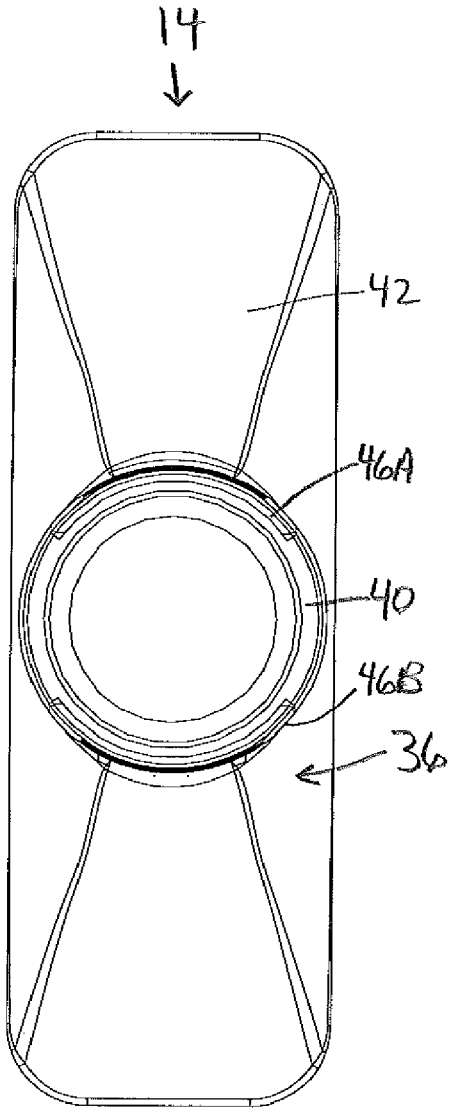
FIG. 4 is a top plan view of the handle accessory.
Figure 5:
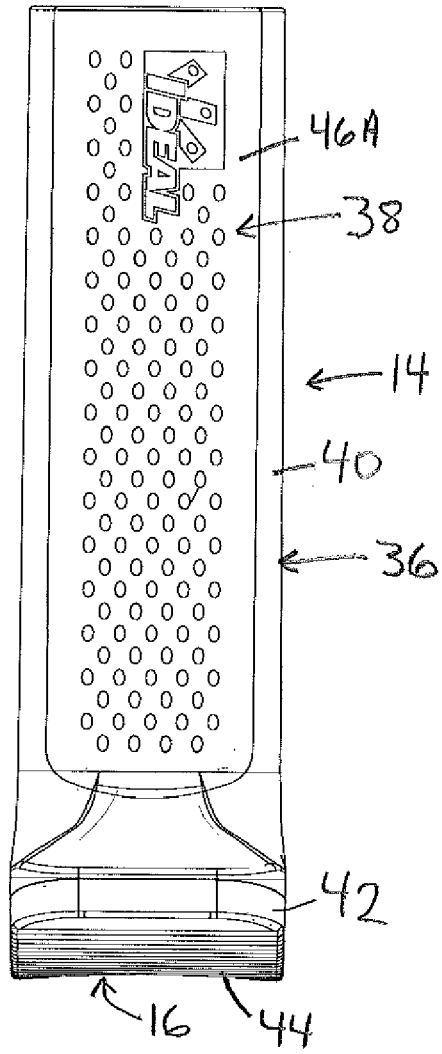
FIG. 5 is an end elevation view of the handle accessory.
Figure 6:
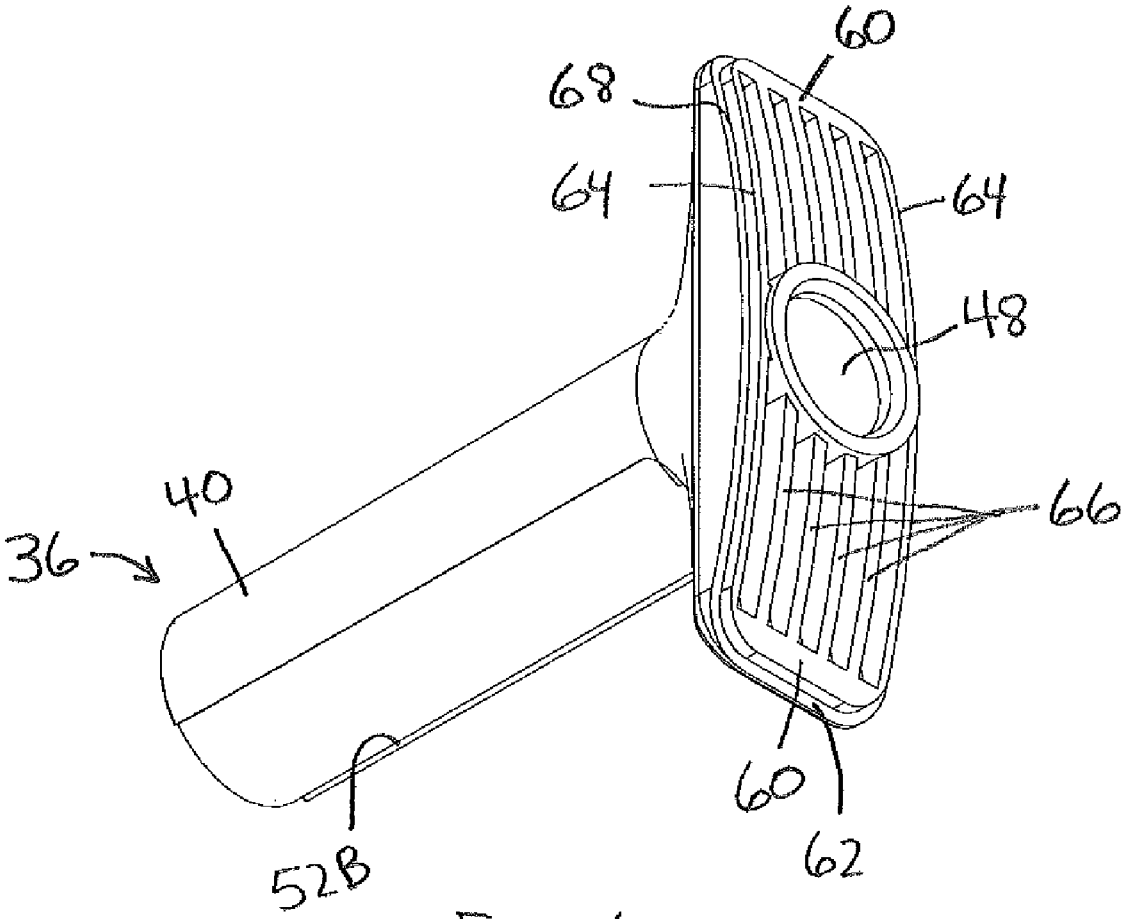
FIG. 6 is perspective view of the base.

FIG. 1 illustrates a conduit bender assembly 10 having the handle accessory 12 of the present invention. The handle accessory includes a support member 14 which defines an anti-skid surface 16. The support member 14 is attached to the free end 18 of a handle 20. The other end 22 of the handle 20 is attached to a conventional bender head 24. The bender head has an arcuate-shaped rocker 26 with a conduit-receiving groove formed therein. A conduit-engaging hook 28 is formed at one end and a foot treadle 30 is at the opposite end of the head 24. In FIG. 1 the user has placed the conduit bender assembly 10 in position for a shoulder bend by putting the handle accessory 12 on a horizontal surface, such as the floor indicated at 32. A conduit 34 is shown in the bender head, engaged by the hook 26. The user has placed the conduit 34 in his armpit and is about to make a shoulder bend by pressing the conduit down and around the rocker 26. In doing so the angle the handle 20 makes with the floor 32 will change. That is, the handle will rock or rotate about the handle accessory 12. As it does so a first contact area of the anti-skid surface 16 will move out of engagement with the floor and a second contact area of the anti-skid surface will move into engagement with the floor. But with the illustrated embodiment of the accessory 12, there will always be an area of the anti-skid surface in engagement with the floor.

The support member 14 is shown in FIGS. 2-5. In this embodiment the support member includes two main components, a base shown generally at 36 and a skin shown at 38. The base 36 includes a hollow hand hold 40 connected to a shoe shown generally at 42. Details of these components will be described below. The skin 38 includes a sole 44 which is attached to the shoe 42. In this embodiment the anti-skid surface 16 is defined by the outer or exterior face of the sole 44. The skin also includes a pair of arcuate grip panels 46A, 46B. In a preferred embodiment the base 36 is an integrally molded component made of polypropylene. The grip panels 46A, 46B are preferably overmolded on the hand hold 40 and made from TPE. The sole 44 is also molded on the shoe 42 and is made of TPE. It will be understood that other materials could be used for the base and skin so long as the base material provides sufficient strength and the skin material provides a relatively high coefficient of friction.

Turning now to FIGS. 6-11, details of the base 36 will be described. As mentioned above the base includes a hand hold 40 and shoe 42. The hand hold 40 is generally a hollow cylinder. The bore 48 of the hand hold has a suitable draft angle. The inside diameter of bore 48 is such that the hand hold fits snugly on the bender handle 20 in what is known as a bicycle grip fit. The hand hold is attached to the handle by tapping the support member and handle combination on a hard surface to get the hand hold all the way on the handle. It will be noted in FIG. 10 that the hand hold 40 extends fully through the thickness of the shoe and terminates at an inwardly-directed flange 50. The flange prevents the handle from pushing all the way through the hand hold. The exterior surface of the hand hold 40 has two elongated depressions or recesses 52A, 52B. The recesses receive the grip panels 46A, 46B of the skin 38. The depth of the recesses preferably matches the thickness of the grip panels so the assembly of the hand hold and grip panels presents a uniform outer diameter.

During conventional bending the hand hold 40 will be contacted by the palm of a user's hand, with the fingers wrapped around the hand hold. Accordingly, the hand hold 40 should be sized in both length and diameter so that it can be comfortably grasped by a user's hand during conventional bending. The length of the hand hold should be such that a portion thereof has sufficient spacing from the shoe 42 to allow the user to grasp said portion without interference from the shoe. The hand hold should also present a relatively smooth surface, free of any projections or irregularities that would impair a user's grip. Similarly, any structure connecting the hand hold to the shoe cannot interfere with a user's grip on the hand hold. Thus, it can be seen that the accessory of the present invention solves the skidding problem during shoulder bends without adversely affecting the use of the bender during conventional bends. The grip panels 46A, 46B are desirable because they enhance a user's grip on the hand hold. Although not shown, in an alternate embodiment it would be possible to include a series of concave contours on the side of the hand hold aligned with the bender hook 28 to receive a user's fingers.

Figure 7:
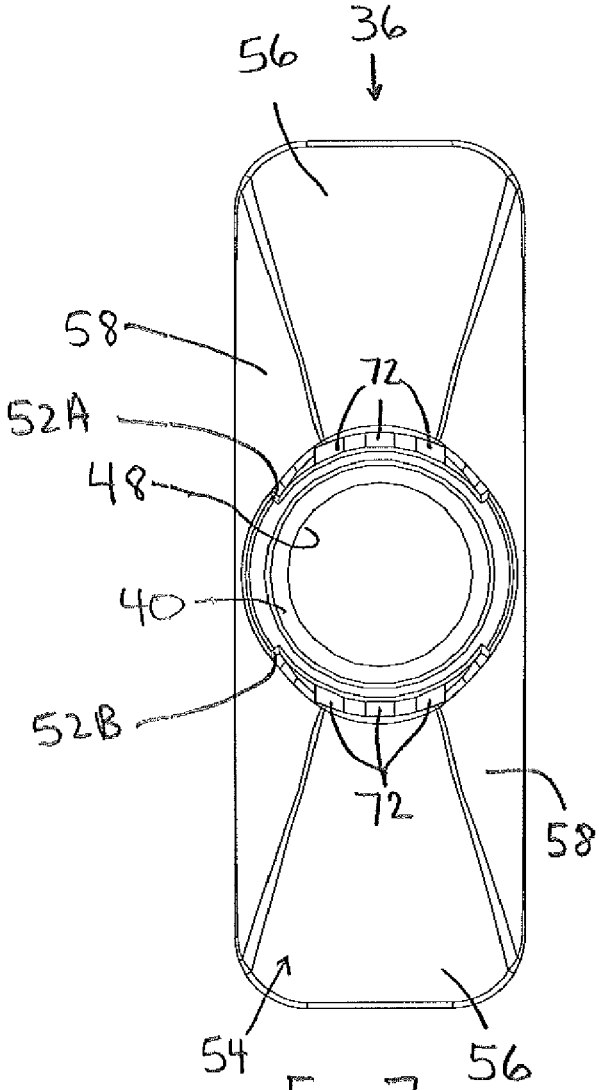
FIG. 7 is a top plan view of the base.
Figure 8:
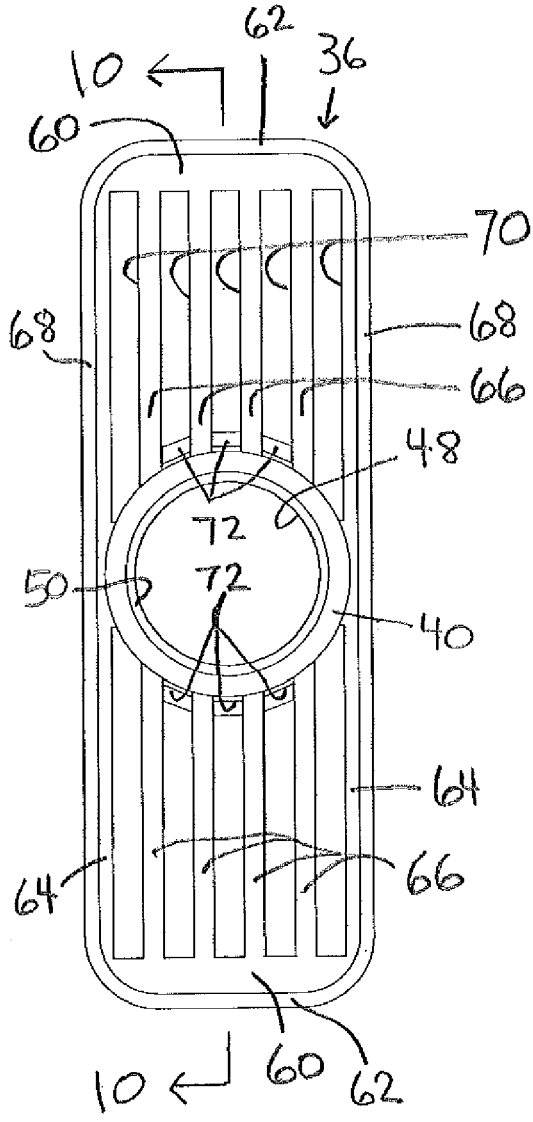
FIG. 8 is a bottom plan view of the base.
Figure 9:
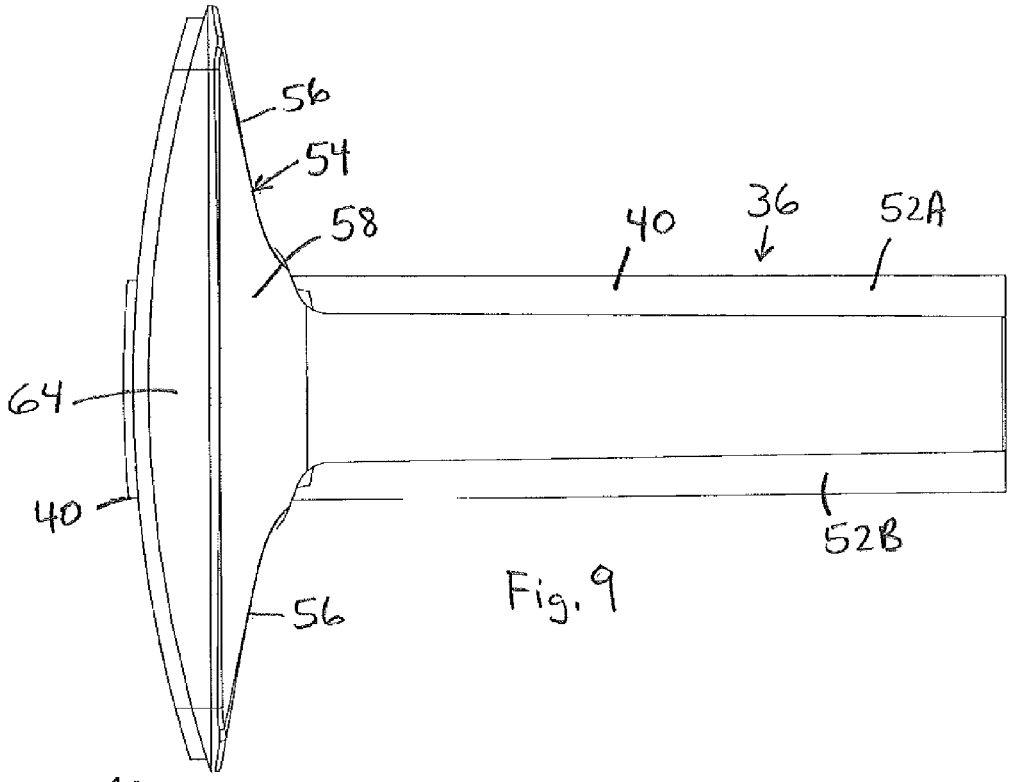
FIG. 9 is a side elevation view of the base.
Figure 10:
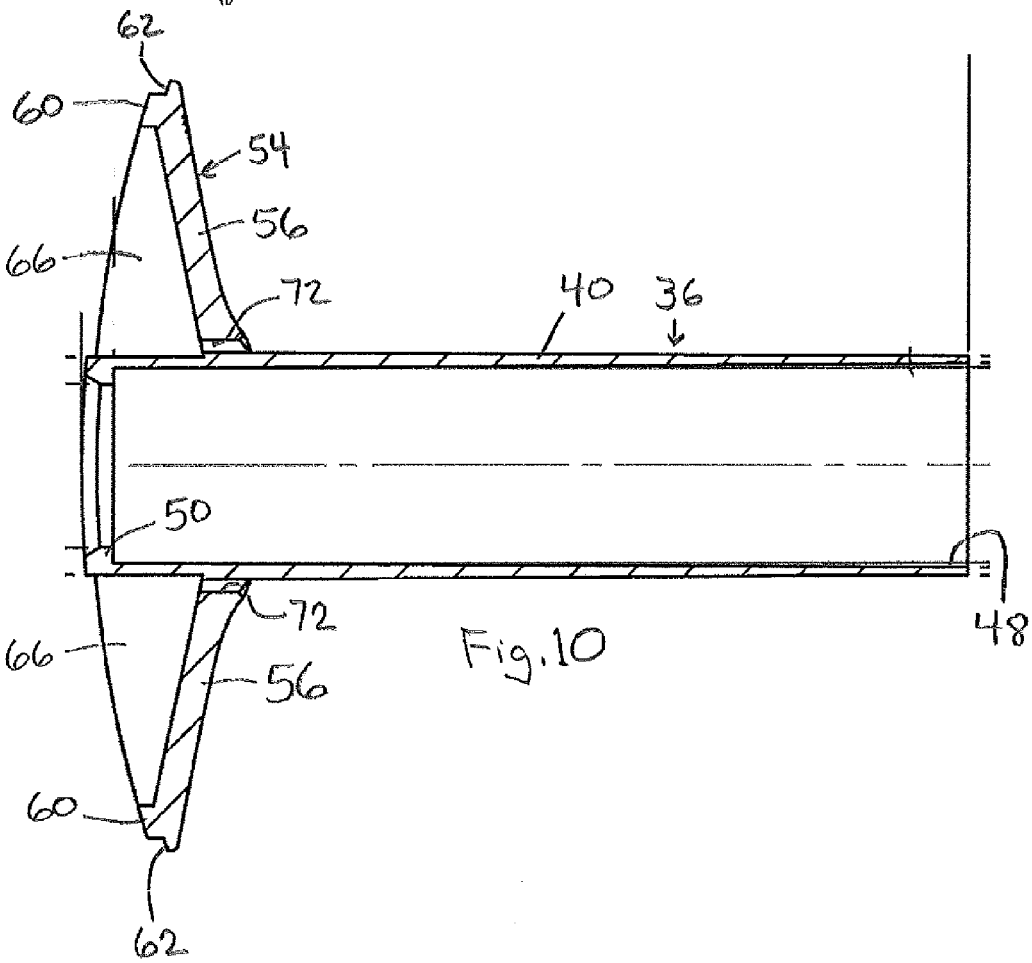
FIG. 10 is a section taken along line 10-10 of FIG. 8.
Figure 11:
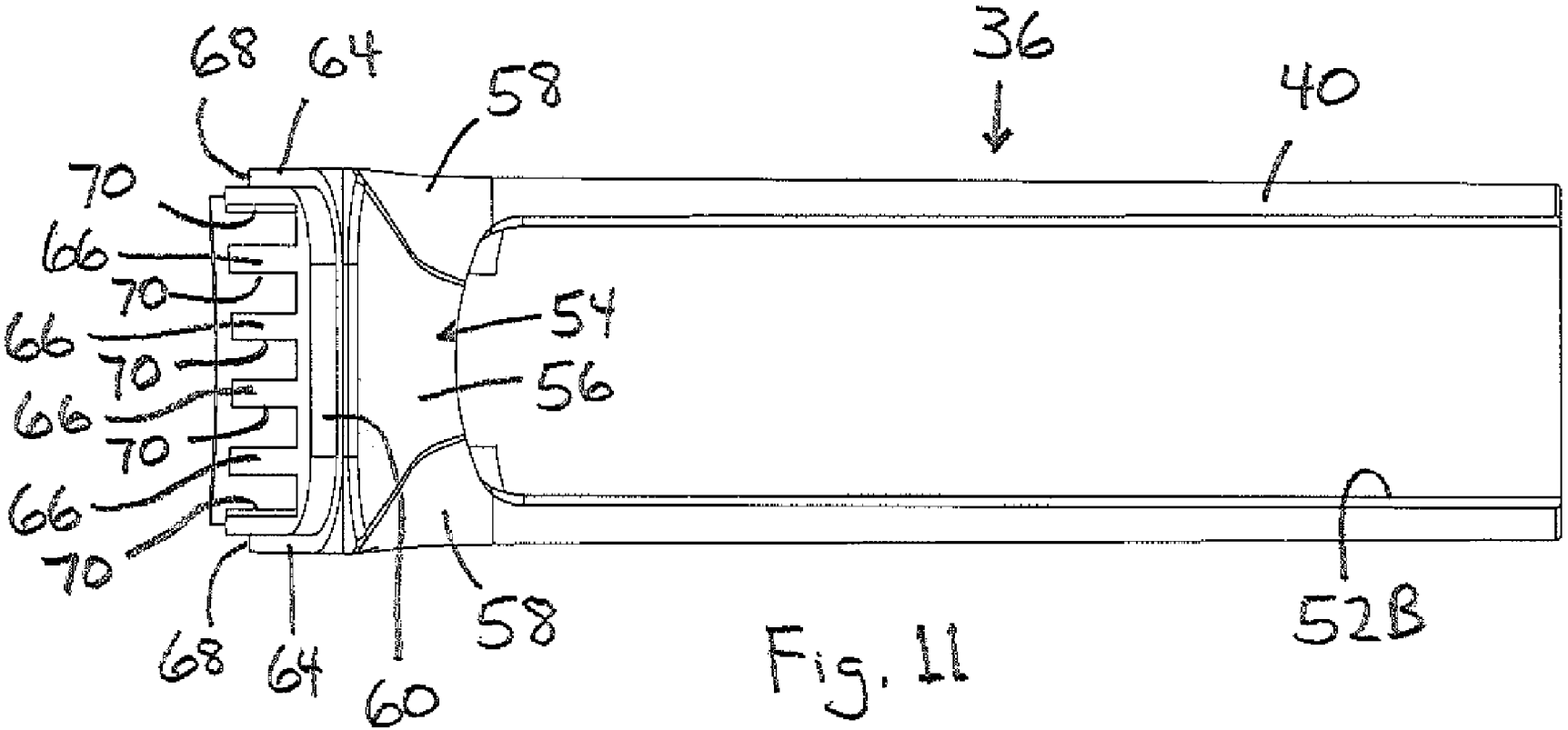
FIG. 11 is an end elevation view of the base.
Figure 12:
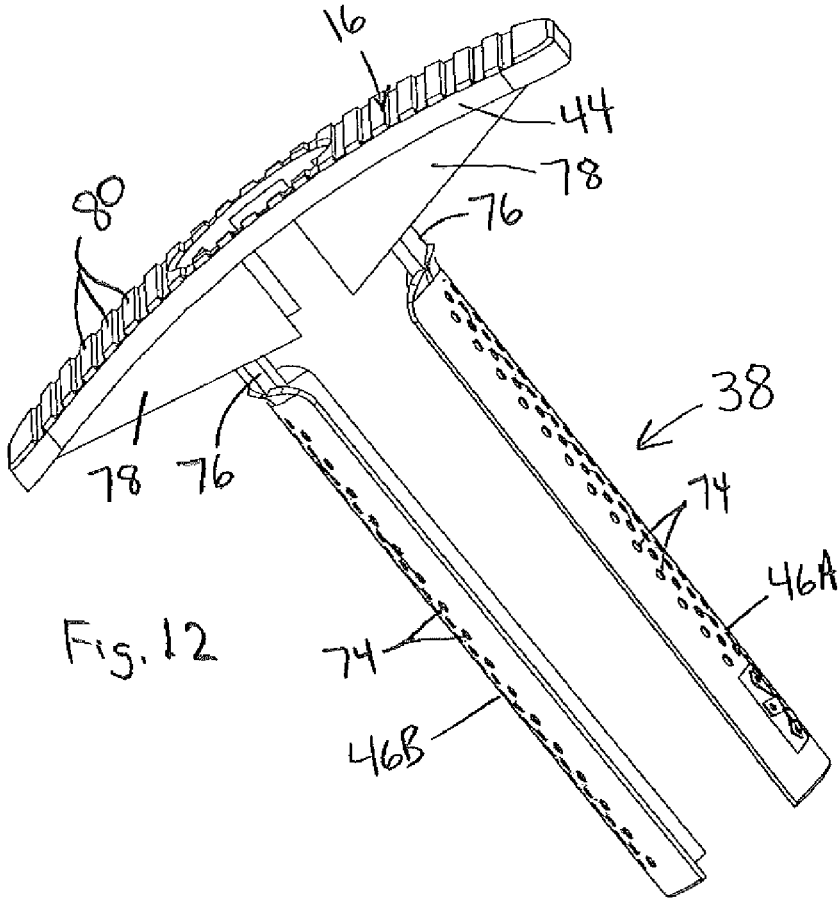
FIG. 12 is a perspective view of the skin portion of the handle accessory.
Figure 15:
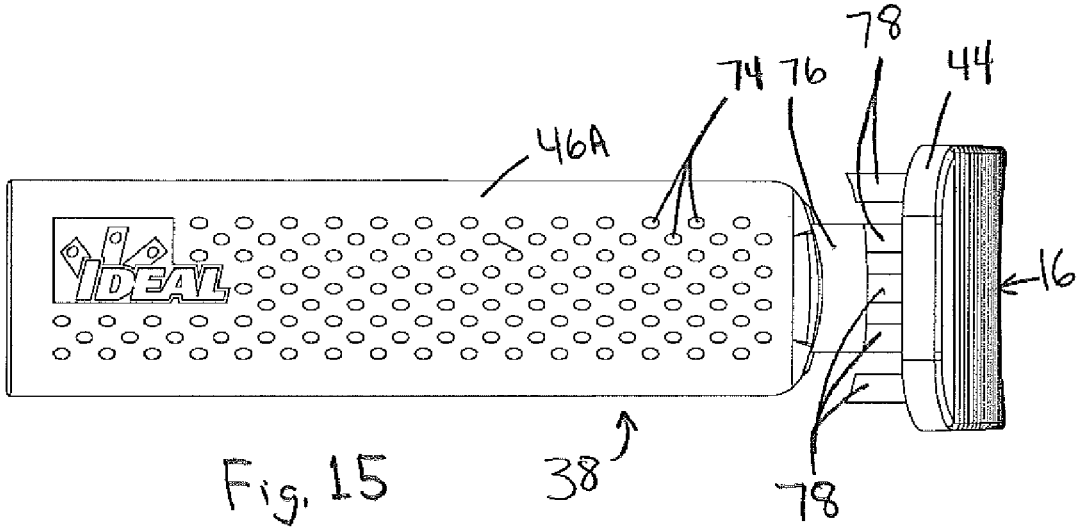
FIG. 15 is an end elevation view of the skin portion.
Figure 13:
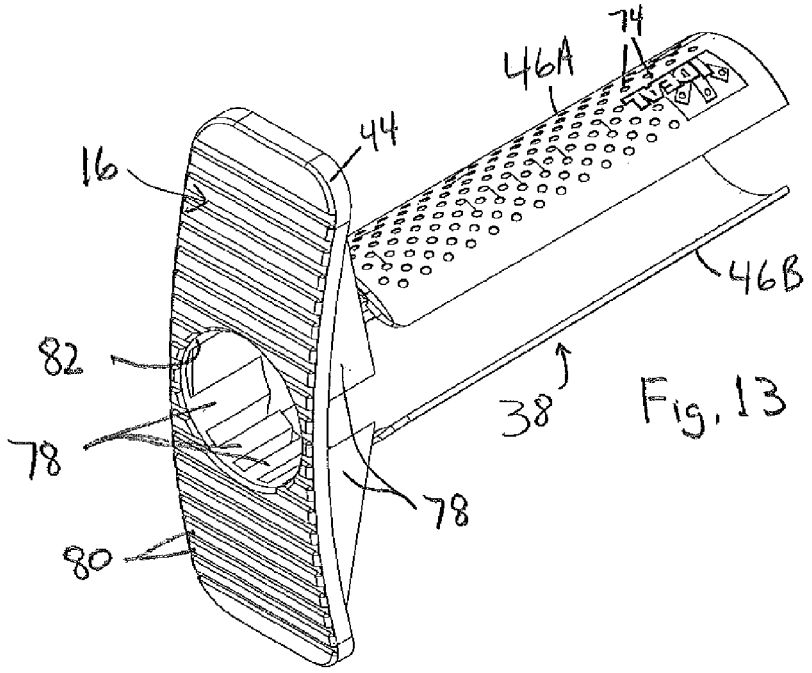
FIG. 13 is another perspective view of the skin portion of the handle accessory.

The shoe 42 includes a backbone 54 which, as best seen in the plan views of FIGS. 7 and 8, has a generally rectangular configuration. The backbone has a pair of relatively flat upper plates 56 on either side of the hand hold 40. The upper plates 56 merge with side portions 58 of the backbone. The upper plates 56 terminate at cross members 60. A notch 62 is formed in the edge of each cross member. A plurality of ribs extend from the backbone. There are two exterior ribs 64 and four interior ribs 66, although the number of ribs could vary. As best seen in FIGS. 9 and 10, the outer edges of the ribs are arcuate or curved. For reference purposes only and not by way of limitation, the radius of the curved edges of the ribs may be about 200 mm. The exterior ribs 64 extend from the side portions 58 of the backbone. They terminate at notches 68. Notches 68 merge with the notches 62 in the cross members 60 to define a rim of the shoe. Pairs of adjacent ribs define channels 70 between them. The channels receive webs of the sole 44 as will be explained below. It will be noted that the interior ends of the upper plates 56 terminate short of the hand hold 40. As a result, three openings or sprues 72 are defined between the hand hold, upper plate and interior ribs 66, as best seen in FIG. 8. These sprues 72 communicate with three of the channels 70 and are used in the overmolding of the skin 38 as will be described below.

Looking now at FIGS. 12-17, details of the skin 38 will be described. It will be understood that the skin is preferably overmolded on the base 36 and accordingly the skin never really exists as a component separate and apart from the base, as these figures might imply. Thus, FIGS. 12-17 are for illustrative purposes to describe how the TPE material is configured on the base. As described above the skin includes two arcuate grip panels 46A, 46B which reside in the hand hold recesses 52A, 52B, respectively. The grip panels each have a pattern of dimples 74 formed on their external surfaces. The grip panels 46A, 46B and dimples 74 enhance a user's grip when using the conduit bender in a conventional manner. During molding the TPE material flows through the sprues 72 and into the recesses 52A, 52B to form the grip panels 46A, 46B. A pair of tabs 76 are formed in this process. These tabs are not visible in the finished product because they are in the interior of the shoe.

Figure 14:
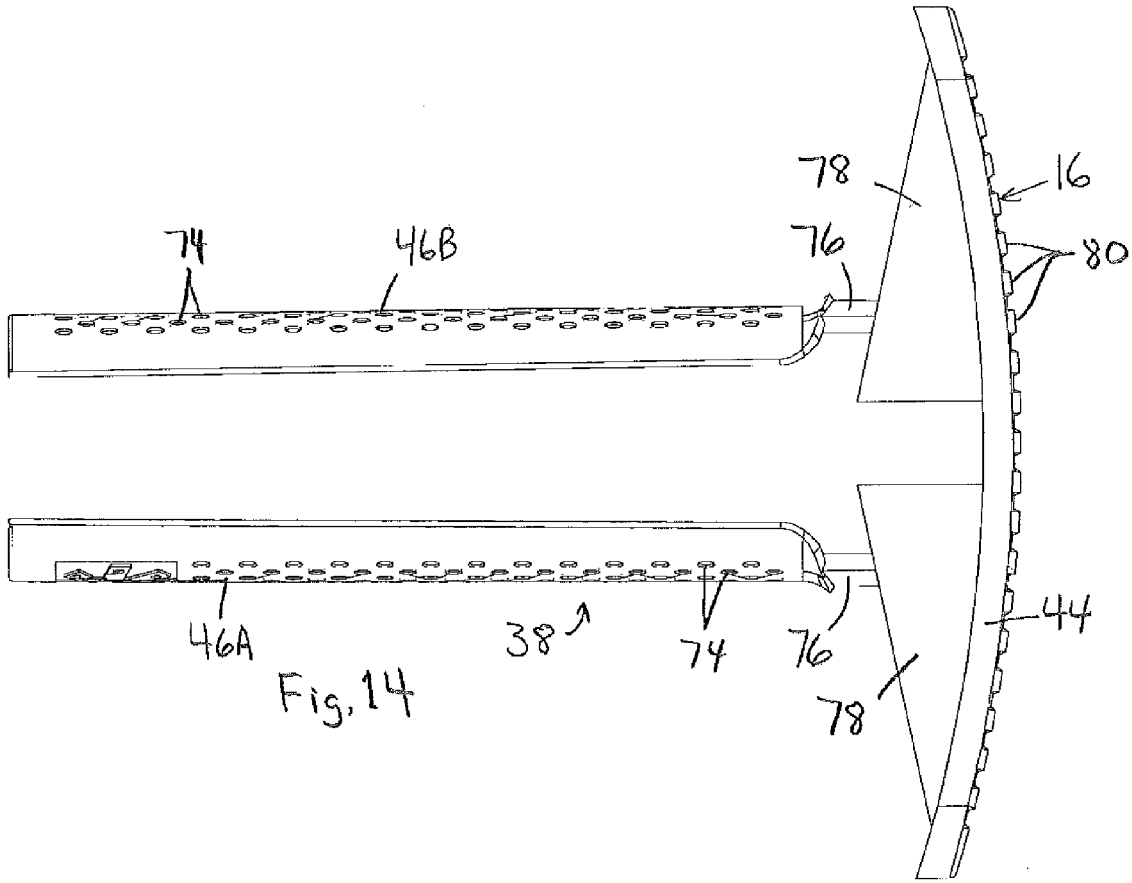
FIG. 14 is a side elevation view of the skin portion.
Figure 16:
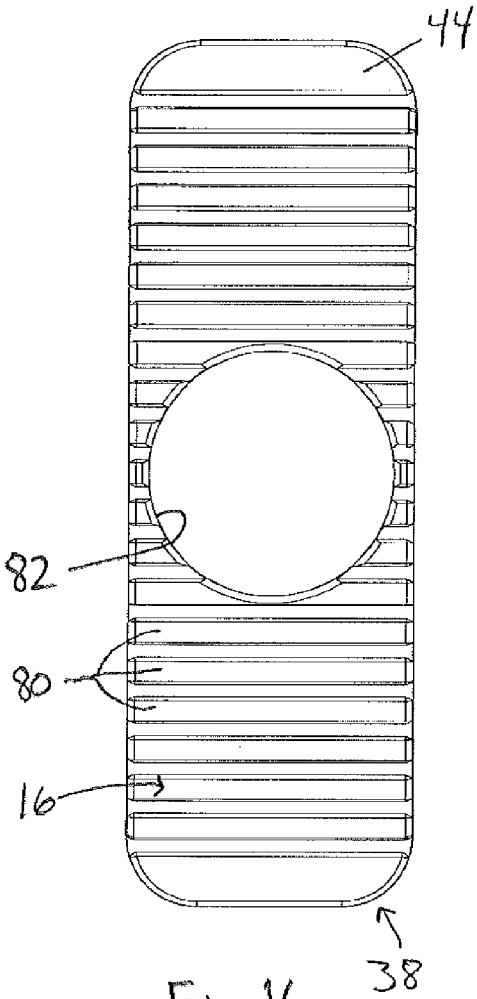
FIG. 16 is a bottom plan view of the skin portion.
Figure 17:
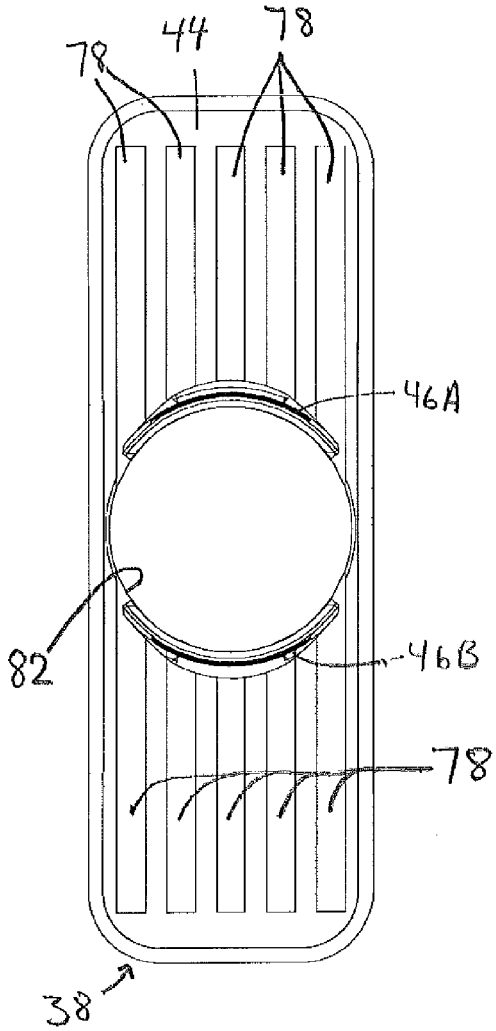
FIG. 17 is a top plan view of the skin portion.

The skin 38 also includes the sole 44. The sole is convex outwardly, as best seen in FIG. 14. The inner surface of the sole has a plurality of webs 78 formed thereon. The webs are formed during overmolding by filling the channels 70 in the shoe 42. Thus, the webs 78 are interleaved with the ribs 64, 66, thereby firmly locking the sole 44 to the shoe 42. The perimeter of the inner surface of the sole engages the notches 62 in the shoe's cross members and the notches 68 in the shoe's exterior ribs to secure the edges of the sole on the shoe. The outer or convex surface of the sole defines the anti-skid surface 16. In this embodiment the anti-skid surface includes a tread carrying a plurality of upraised, transverse ridges 80. The ridges enhance the gripping ability of the anti-skid surface 16 on a horizontal surface.

A central aperture 82 in the sole and through the webs 78 provides access to the hand hold 40. This is desirable to permit an end of a conduit to be placed into the hand hold, and into the handle, to secure the conduit to permit bend backs. That is, on occasion a user may bend a conduit too far for the particular application. This can be corrected by a bend back.

It can be seen that the contoured anti-skid surface provides that there will always be an area of the anti-skid surface in contact with the floor. As the handle 20 rotates, one portion of the anti-skid surface will release from the floor but another portion will engage the floor. This is the preferred arrangement of the anti-skid surface. However, in an alternate embodiment, it may be possible to have a flat anti-skid surface, either perpendicular to the handle axis or at some angle thereto. If a flat anti-skid surface is used, it should have an enlarged area compared to the area of the cross section of the handle. The anti-skid surface area should be at least about 1.5 times the cross sectional area of the handle. Other contours for the anti-skid surface are possible, e.g., two planar surfaces at an angle to one another, or a spherical surface.

It is also pointed out that while the two-piece construction illustrated for the support member is an efficient way to achieve the strength needed for the base and the friction characteristics needed for the anti-skid surface, the support member need not be two pieces. The anti-skid surface could be defined by a single piece support member.

As can be seen from the above description, the present invention has several different aspects, which are not limited to the specific structures shown in the attached drawings and which do not necessarily need to be used together. Variations of these concepts or structures may be embodied in other structures without departing from the present invention as set forth in the appended claims. For example, instead of the generally T-shaped accessory shown and described and resulting from having a backbone with two upper plates extending from opposite sides of the hand hold, the accessory could have a backbone with only a single upper plate extending from the hand hold, making it generally L-shaped. Or the shoe could be spherical or partially spherical. That is, instead of the shoe being generally rectangular as seen in the top plan view of FIG. 4, it could be arcuate or circular in that view. Also, while the support member is shown as being made in two parts, the base and skin, it will be understood that the support member could be a single part with the anti-skid surface defined by the exterior of an integral shoe. The hand hold could be altered to provide an alternative structure for connecting the support member to the handle. For example, instead of being a full cylinder, the hand hold could have longitudinal slots separating it into multiple fingers. Any suitable arrangement for connecting the shoe to the hand hold could be used.

What is claimed is:

1. A handle accessory for a conduit bender, the handle accessory comprising:

a support member engageable with a handle of a conduit bender and defining an anti-skid surface, the anti-skid surface being engageable with a horizontal surface, said anti-skid surface having a first contact area engageable with the horizontal surface when the handle is at a first angle to the horizontal surface and a second contact area engageable with the horizontal surface when the handle is at a second angle to the horizontal surface, the support member including a cylindrical hand hold which is engageable with the handle of a conduit bender and has sufficient length for comfortable engagement by a user's hand.

2. The handle accessory of claim 1 wherein the support member comprises a base and a sole, the sole having an interior portion connected to the base and an exterior portion which defines the anti-skid surface.

3. The handle accessory of claim 2 wherein the base further comprises a shoe connected to the hand hold, the sole being connected to the shoe.

4. The handle accessory of claim 3 wherein the shoe comprises a backbone extending from the hand hold and a plurality of ribs connected to the backbone, the sole being attached to the ribs.

5. The handle accessory of claim 3 wherein the hand hold is hollow and sized to receive the handle therein.

6. The handle accessory of claim 3 further comprising at least one grip panel covering at least a portion of the hand hold, the grip panel being formed of a material that has a higher coefficient of friction than the material of the base.

7. The handle accessory of claim 1 wherein the anti-skid surface has a convex shape.

8. A handle accessory for a conduit bender, the handle accessory comprising:

a shoe having a sole which defines an anti-skid surface, the anti-skid surface being engageable with a horizontal surface; and a hand hold connected to the shoe, the hand hold being engageable with the handle of a conduit bender and having sufficient length for comfortable engagement by a user's hand.

9. The handle accessory of claim 8 wherein the hand hold is engageable with the handle of a conduit bender.

10. The handle accessory of claim 9 wherein the hand hold is hollow and sized to receive the handle therein.

11. The handle accessory of claim 8 wherein the shoe comprises a backbone extending from the hand hold and a plurality of ribs connected to the backbone, the sole being attached to the ribs.

12. The handle accessory of claim 8 further comprising at least one grip panel covering at least a portion of the hand hold, the grip panel being formed of a material that has a higher coefficient of friction than the material of the shoe.

13. The handle accessory of claim 8 wherein the anti-skid surface has a non-planar contour.

14. The handle accessory of claim 13 wherein the anti-skid surface has a convex shape.

15. A conduit bender assembly, comprising:

a handle and a bender body attached to one end of the handle;

a handle accessory attached to the other end of the handle, the handle accessory comprising a support member defining an anti-skid surface engageable with a horizontal surface and having an aperture in the anti-skid surface, the aperture being sized for receiving the end of a conduit.

16. The handle accessory of claim 15 wherein the support member comprises a base and a sole, the sole having an interior portion connected to the base and an exterior portion which defines the anti-skid surface.

17. The handle accessory of claim 16 wherein the base comprises a hand hold engageable with the handle and a shoe connected to the hand hold, the sole being connected to the shoe.

18. The handle accessory of claim 17 wherein the shoe comprises a backbone extending from the hand hold and a plurality of ribs connected to the backbone, the sole being attached to the ribs.

19. The handle accessory of claim 17 wherein the hand hold is hollow and sized to receive the handle therein.

20. The handle accessory of claim 17 further comprising at least one grip panel covering at least a portion of the hand hold.

21. The handle accessory of claim 15 wherein the anti-skid surface has a convex shape.

22. A method of preventing a handle of a conduit bender from slipping when shoulder bending, the method comprising the steps of:

attaching to the handle a support member having an anti-skid surface;

engaging a first contact area of said anti-skid surface with a horizontal surface with the handle at a first angle to the horizontal surface; and disengaging the first contact area and engaging a second contact area of said anti-skid surface with the horizontal surface as the handle is moved from said first angle to a second angle with the horizontal surface.

* * * * *